United States Patent [19]

Masuda et al.

[11] Patent Number: 4,574,018

[45] Date of Patent: Mar. 4, 1986

[54] PILE FABRIC PRODUCTION PROCESS

[75] Inventors: Yutaka Masuda; Teruo Nakamura, both of Otsu, Japan

[73] Assignee: Toray Industries, Inc., Tokyo, Japan

[21] Appl. No.: 567,265

[22] Filed: Dec. 30, 1983

[30] Foreign Application Priority Data

Jan. 7, 1983 [JP] Japan ..... 58-446

[51] Int. Cl.[4] ..... D04H 11/00; B32B 5/02

[52] U.S. Cl. ..... 156/72; 156/155; 427/26; 427/206; 427/352; 428/90; 428/95

[58] Field of Search ..... 156/155, 168, 72, 344, 156/283, 83; 428/91, 90, 95; 427/26, 206, 352

[56] References Cited

U.S. PATENT DOCUMENTS

| | | | |
|---|---|---|---|
| 3,865,678 | 2/1975 | Okamoto et al. | 428/91 |
| 4,241,122 | 12/1980 | Asano | 428/91 |
| 4,390,566 | 6/1983 | Umezawa et al. | 156/72 |
| 4,415,611 | 11/1983 | Yamagata et al. | 156/72 |

*Primary Examiner*—Michael Ball

*Attorney, Agent, or Firm*—Austin R. Miller

[57] ABSTRACT

Pile fabric having excellent softness and high tear strength which has short fibers planted and adhered to a base with an adhesive, is obtained by applying an adhesive and planting the short fibers to the base, drying or curing the adhesive, and removing at least 5 weight % of the fibers of the base.

10 Claims, 1 Drawing Figure

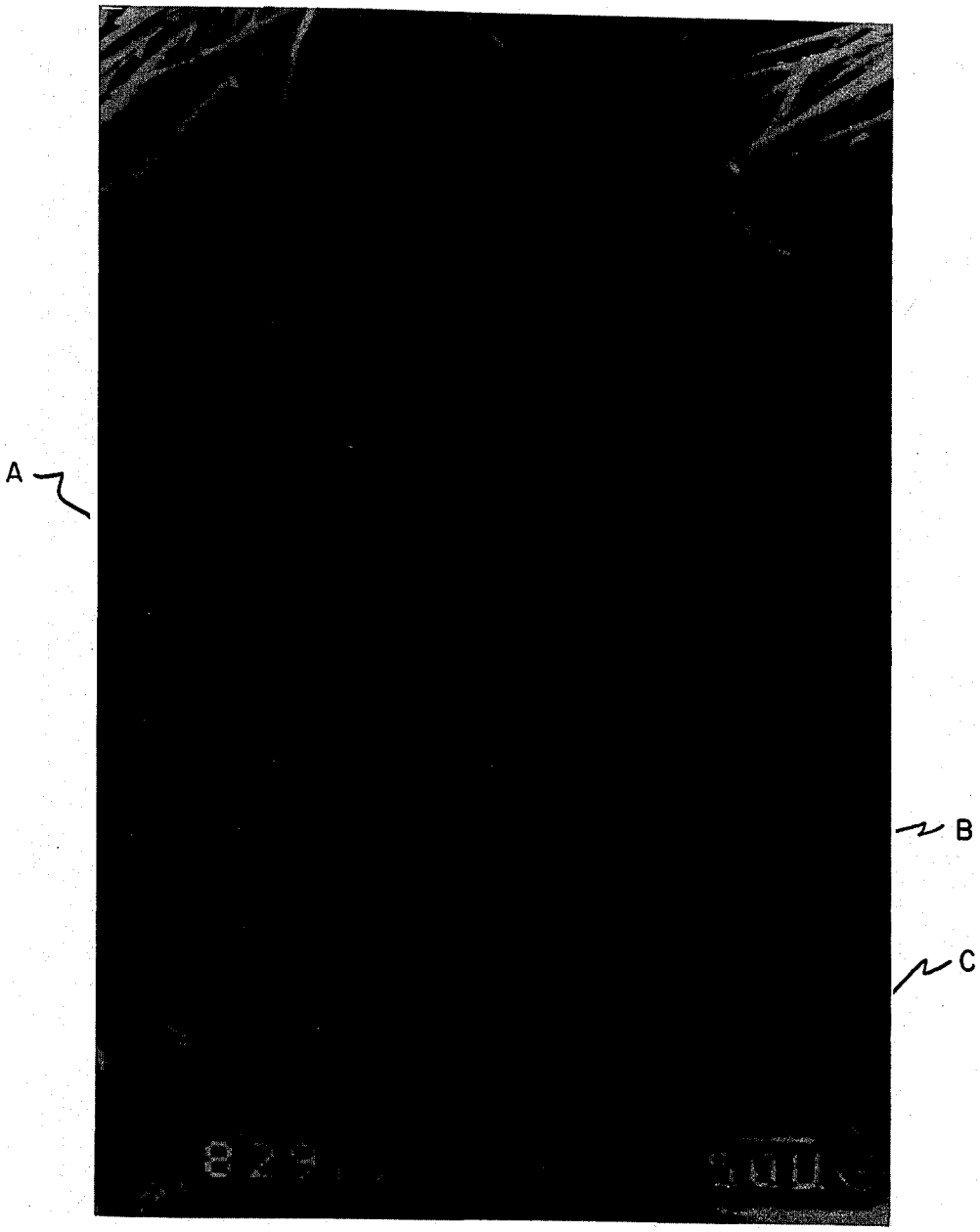
A
B
C

PILE FABRIC PRODUCTION PROCESS

Field of the Invention

The present invention relates to a process for production of soft pile fabrics.

BACKGROUND OF THE INVENTION

Conventionally so-called pile fabrics are used for various purposes. They are obtained by adhering short fibers to a base, using gravity or static electricity. Many of them are producible only by applying an adhesive to the base, planting dyed short-fiber piles therein, and hardening the adhesive. The piles to be implanted had been limited both in thickness and length. Fine, long fiber piles had been generally difficult to implant. However, it is proposed to flock separable type composite fibers such as islands-in-a-sea type composite fibers or multi-core type composite fibers composed of polyester or polyamide and to separate the separable fibers after flocking. By this method a flocked fabric with an extremely-fine-denier touch surface may be obtained. However, the adhesive must be used in great quantities to prevent falling out of the pile fibers. Large amounts of the adhesive and high bonding strength are necessary when a solvent or a swelling agent is used to separate the pile fibers and when thicker and longer piles are used, as in a fur like fabric. Hard texture of the flocked fabric has also been one of the important defects.

On the other hand, Canadian Pat. No. 895611 and U.S. Pat. No. 3,865,678 teach removing one of the fiber components after impregnating an elastomer to make the fabric soft. Further, Canadian Pat. No. 167512 teaches the use of raised fabric as a base of the pile fabric. However, even using a soft fabric as a base for a pile fabric, the resulting pile fabric becomes hard owing to the large amount of adhesive needed to fix the piles firmly. Therefore, such a method has not been used for making clothing, which requires a soft texture.

SUMMARY OF THE INVENTION

This invention relates to a process for producing a soft pile fabric in which the piles are fixed to a fiber base with an adhesive, wherein a part of the base is removed after hardening the adhesive.

Through this process the product is a very soft, highly-drapable pile fabric with a high tear strength, with no real decrease of falling out resistance of the pile fabric. It is therefore suitable for clothing which requires softness in particular, as well as for various non-clothing uses (e.g., seat covers, wall coverings, curtains, bags, automobile fittings, etc.)

The effect of the present invention is not limited by the structure of the short-fiber piles. Soft, fine short-fiber piles, however, ensure a high commodity value, particularly the ones with less than 1 denier which are preferably used. On the other hand, the present invention makes it possible to produce an artificial fur which is soft enough for use as clothing.

BRIEF DESCRIPTION OF THE DRAWING

FIG. 1 is a photograph showing a sectional view of a fiber of a flocked fabric of the present invention.

DETAILED DESCRIPTION OF THE INVENTION

The pile fabric in accordance with the present invention can be obtained by planting short fibers by electrostatic flocking or needle punching and raising, for example.

The short fibers in accordance with the invention include polyester, polyamide, acrylic or other synthetic fibers; rayon or other regenerated fibers; and natural fibers; but are not limited thereto.

Also, the thicknesses and lengths of the short-fiber piles to be implanted are not limited. Even superfine fiber piles can be produced through implanting separable fibers.

Soft, fine short-fiber piles, however, ensure a high commodity value, particularly the ones with 0.3 to 5.0 mm length and less than 1 denier, especially 0.01 to 0.5 denier, which are preferably used. In such cases, separable fibers such as islands-in-sea type fibers, or multi-core composite fibers whose cores are located at the surface of the fiber, are preferably used. Of course, the separable fibers of ordinary denier are separated after implantation.

On the other hand, this invention is also preferably applied to an artificial fur, in which the guard hair component preferably uses both end tapered short fibers of 10 to 200 denier at the body portion and of 20 to 200 mm length, and the down hair component preferably uses short fibers of 0.1 to 5 denier and of 10 to 100 mm length.

In the pile fabric in accordance with the present invention, the adhesive is left with many narrow continuous spaces which are brought about by removing a part of the fiber base. The continuous narrow spaces make the adhesive layer very soft without reducing the adherence between the piles and the fiber base. The fibers of the base are not necessarily adhered to the adhesive and are preferably only bound with the adhesive along the fiber axes, allowing free movement of the fibers in the intervening spaces. This structure is obtained by removing a part of the fiber of the base, as by dissolving a component of a sheath-core fiber with a solvent, or separating a multi-core composite fiber with a swelling agent, or removing a surface portion of a polyester fiber base with an alkali reagent. Especially, removing the sea components of islands-in-sea type composite fibers creates spaces along the fiber axes and allows movement as between the individual island fibers and between the fiber bundle and the point of adherence to the base.

This is considered to be the reason for the fabric's soft texture and high tear strength. On the other hand, the bundles themselves are securely held by the adhesive. The base and adhesive therefore do not peel off from each other, i.e., the adhesive is impregnated into the base to some extent and, in that portion, surrounds and holds each fiber of the base.

The materials and structures of the base in accordance with the present invention are not limited, provided that at least 5% by weight of its component is removable through dissolution or decomposition by an appropriate method. The materials include polyester, polyamide, acrylic and other synthetic fibers; rayon and other semi-synthetic fibers; cellulose, wool and other natural fibers; and mixtures thereof (blended during spinning, doubling, weaving or knitting). In terms of structures various kinds of fabrics such as woven, knitted and unwoven fabrics are included.

The method for removing by dissolving or decomposing more than 5% by weight of the base in accordance with the present invention includes:

(1) Dissolution or decomposition of one component of composite filaments, (2) Mixing with the fiber destined ultimately to form the base, a further fiber dissoluble or decomposable by an appropriate method, (3) Use of a fiber which is dissoluble or decomposable from the surface, and (4) Impregnation in the base of more than 5% by weight of a removable material before applying the adhesive.

Methods (1) include those for carrying out the dissolution or decomposition removal and the fining treatment of the pile fiber of an islands-in-a-sea type composite fiber at the same time; methods (2) the dissolution or decomposition removal out of the blended fabrics comprising water- and/or alkali soluble fibers; methods (3) utilization of alkali hydrolysis of polyesters; and methods (4) removal of a sizing agent or a resin added to the fabrics.

Methods for dissolution or decomposition removal in accordance with the present invention are not limited to those mentioned above.

It is preferable in accordance with the present invention to remove by more than 5% by weight of the base by dissolution or decomposition. Otherwise, sufficient softening effect as in the present invention cannot be expected. It is not necessary to fix the upper limit of dissolution or decomposition ratio. It is however preferable to remove less than 60% by weight, particularly less than 40% by weight to ensure sufficient base strength and adequate peel strength of the adhesive layer.

The adhesives to be used in the present invention are not limited but required to withstand the chemicals and conditions to be adopted for the dissolution or decomposition removal of a part of the base.

In view of the foregoing, the use of an islands-in-a-sea type fiber which comprises the same sea component as the fibers of the base and the pile is most preferable for the present invention, since it provides a soft texture for flocked fabrics and enables removal of the base components and the fining process of the pile components to be effected simultaneously. Further, the use of a polyurethane type adhesive is preferable from the standpoint of dissolution resistance treatment and texture.

The amount and penetration depth of the adhesive in the base influences the softness of the fabric. An excess amount or excessively deep penetration of the adhesive often results in too hard a fabric. The preferable amount of adhesive is 30 to 150 g/m$^2$. The penetration depth of the adhesive may be controlled by changing the viscosity of the adhesive, the coating condition, the drying temperature or by pretreatment of the base cloth, such as raising or with water or oil-repellent agent.

Crumpling of the fabric during or after dissolution or decomposition removal of a component of the base is preferable because it increases the softening effect. Further, the process in accordance with the present invention has been found to improve the tear strength of the flocked fabric.

It is preferable to use an islands-in-a-sea type fiber base that enables removal of a part of the base and fining of the pile to be carried out at the same time. For separable composite fiber bases, where components are recovered by peeling, and where fining does not bring about removal, only a small softening effect can be obtained; thus the softening effect must be attained by another method.

Through this process, an exceptionally soft, highly-drapable pile fabric is obtained with a high tear strength. The implanted fibers encounter no real decrease in falling out resistance. The fabric is therefore suitable for clothing which requires softness in particular, and is also suitable for various non-clothing uses (e.g., seat covers, wall coverings, curtains, bags, automobile fittings, etc.)

The present invention will be described hereinafter in connection with the following examples:

EXAMPLE 1 and COMPARATIVE EXAMPLE 1

Piles were obtained by cutting into lengths of 1.0 mm an islands-in-a-sea type fiber whose sea and island components were polystyrene and polyethylene terephthalate (4 denier, sea/island ratio=20/80, number of islands=16). The cut fibers were subjected to 60° C.×15 min. scouring in a bath containing 1 g/ of a non-ionic surface active agent; hydroextraction; 40° C.×20 min. immersion in a bath containing 2% by weight of sodium silicate, 3% by weight of colloidal silica ("SNOWTEX C" made by Nissan Kagaku K.K.), and 0.2% by weight of potassium chloride (modified at pH4 with acetic acid); hydroextraction; and drying.

The pile was electrostatically implanted to form a flocked fabric (voltage=30,000 V, distance between electrodes=10 mm) at a rate of 120 gr./m$^2$ by flocking upwardly after applying a solvent type polyurethane adhesive (25% polyether type polyurethane DMF solution) to a needle punch felt base (unit weight=200 gr./m$^2$, thickness=1 mm) of a similar islands-in-a-sea type fiber (4 denier, sea/island ratio=30/70, number of islands=36) at a rate of 300 g/m$^2$ with a knife coater. The flocked fabric thus obtained was subjected to 100° C. drying, 130° C.×3 min. curing, and immersion in trichloroethylene (3 times at room temperature) for removing 29% of the whole fiber base. The flocked fabric thus obtained was much softer than that before the removal of the sea component. It was further subjected to conventional dyeing at 120° C. with a liquid-flow dyeing machine. The flocked fabric thus obtained became softer and was highly drapable and gave a high-grade feeling. It had a cantilever method softness value of 31 mm (compared to 140 mm immediately after flocking) and a high tear strength of 3,500 gr. (mean value of lateral and longitudinal tear strengths).

FIG. 1 is a scanning type electron-microscope photograph of the flocked fabric. It indicates that the monofilament bundles of its base are not completely bonded but have a structure with voids at the section where the adhesive and base are bonded. A represents pile fibers, B represents an adhesive layer and C represents the base fabric.

At the same time, a comparative example was prepared by a process according to Example 1 except that the sea component removal was carried out before flocking.

Compared with the Example, the flocked fabric thus obtained was much harder and had a softness value of 82 mm and a tear strength of 1,700 gr, which were considerably inferior to the example. As a result of observations with a scanning type electron-microscope, it was found that the adhesive has penetrated into the fiber bundles of the base, with practically no void structure.

EXAMPLE 2 and COMPARATIVE EXAMPLE 2

A plain weave base (weight: 140 g/m$^2$) made of blended yarn composed of 25 weight % of a readily alkali soluble polyester fiber (a copolymer of 7 mol % of 5-sodium sulfoisophthalate and 93 mol % of ethylene terephthalate) and 75 weight % of ordinary polyethlene telephthalate fiber was subjected to the same manner of flocking as Example 1. The sea component of its pile was removed in trichlorethylene, and the readily alkali soluble polyester in its base was removed with a 3% NaOH solution at 95° C. 26 weight % of the base was removed. The softness of the flocked fabric thus obtained was measured by the cantilever method. At the same time, a comparative example was prepared wherein the readily alkali soluble fibers of the base were removed before flocking and then flocking according to example 1 was applied.

As the result, the flocked fabric in accordance with the present invention showed a much higher softness of 35 mm than that before the removal of the alkali readily removable fibers (135 mm) and the fabric of the comparative example (95 mm).

EXAMPLE 3

A pile was obtained through a process wherein an islands-in-a-sea type fiber (3.5 denier, sea/island ratio=15/85, number of islands=6) whose sea and island components were a readily alkali soluble polyester (a copolymer of 7 mol % of 5-sodium sulfoisophthalate and 93 mol % of ethylene terephthalate) and polyethylene terephthalate. The fiber was cut to lengths of 1 mm and electrostatic flocking was applied in Example 1.

Flocking was carried out after applying a solvent type polyurethane binder (obtained by adding one part of a diphenylmethane-bis-4,4'-N, N'-ethyleneurea bridging agent to a 25% polyether polyurethane DMF solution) to a twill fabric base (unit weight 130 gr./m$^2$) whose warp and weft were made from the above said islands-in-a-sea type fiber filaments to 300 gr./m$^2$. The flocked fabric thus obtained was subjected to 100° C. drying, 140° C.×2 min. curing, and 80° C.×1 hour treatment with a 3% NaOH solution for removing the sea component of the pile and base, and conventional 120° C. dyeing with a circular liquid flow dyeing machine. The flocked fabric thus obtained was soft and highly-drapable and gave a high-grade feeling.

EXAMPLE 4

A guard hair component was made with both end tapered fibers of polybutyleneterephthalate (35 denier, 17 mm length) having a flat cruciform cross-section (large diameter/ short diameter=2.5. It was prepared according to the method of U.S. Pat. No. 4,381,325. A down hair component was prepared with both end tapered fibers of polybutyleneterephthalate (5 denier, 17 mm length) having round cross sections.

The guard hair component was dyed black with Samaron Black BBL-liq. 10% owf (disperse dye supplied by HOECHST AG) and Samaron Brown 2GSL-N 12% owf (disperse dye supplied by HOECHST AG) at 120° C., 60 minutes. The down hair component was dyed dark brown with Miketon Polyester Orange 3% owf (supplied by Mitsui Toatsu Kagaku Co. Ltd.), Foron Rubine S-2GFL 0.5% owf (disperse dye supplied by Sand Co. Ltd.) and Sumikalon Blue S-BG 1.5% owf (disperse dye supplied by Sumitomo Kagaku Co. Ltd.).

The same weights of both components were well mixed by air.

As a base, a needle punched felt was made having a weight of 200 g/m$^2$ composed of islands-in-sea type fibers (3.5 denier, number of islands: 20, thickness of each island: 0.1 denier, islands component: polyethylene terephthalate, sea component: polystyrene). The mixed hair component was spread uniformly on the base at a weight of 1200 g/m$^2$ and implanted in the base by needle punching using needle FPD-1#36 (supplied by Organ Co. Ltd.). Then the undersurface of the implanted base was treated with 25 weight % of an aqueous solution of polyvinylalcohol. After drying the treated surface, the implanted surface was raised and the polyvinylalcohol was removed with hot water at 50° C., and then the fabric was dried. After shearing the hair fibers which protruded from the undersurface, the undersurface of the raised fabric was treated by knife coating with Sunplen LQ-T1502 (polyurethane solution in dimethyformamide supplied by Sanyo Kasei Co. Ltd.).

The polystyrene which constituted a component of the base was removed with trichlorethylene at room temperature. Next, the fabric was subjected to reduction clearing with NaOH 1g/l, $Na_2S_2O_4$ $2H_2O$, 1g/l, surface active agent 1g/l at 80° C. 30 min. The obtained artificial fur was very soft and looks similar to black mink fur.

We claim:

1. A process for producing a pile fabric which comprises providing a fiber base composed of composite fibers, which fibers comprise at least two individual components, applying an adhesive to said fiber base, electrostatically implanting short flock fibers in said adhesive and fiber base, hardening said adhesive with said short fibers in place, and thereafter removing at least one component of the fiber base.

2. A process according to claim 1, wherein the fiber of the base includes a polyester as one of said components and the removal is effected by alkali treatment.

3. A process according to claim 1, wherein the fiber of the base is a sheath-core type composite fiber.

4. A process according to claim 3, wherein the fiber of the base is an islands-in-sea type composite fiber.

5. A process according to claim 1, wherein the short fibers are composed of at least two different fibers differing in thickness and length.

6. A process according to claim 5, wherein at least the thicker fibers are both end tapered fibers.

7. A process according to claim 1, wherein hardening of the adhesive is developed by drying.

8. A process according to claim 1, wherein hardening of the adhesive is developed by curing.

9. A process according to claim 1, wherein removal is effected by treatment with solvent.

10. A process according to claim 1, wherein removal is effected by decomposition.

* * * * *